US005611943A

United States Patent [19]

Cadien et al.

[11] Patent Number: 5,611,943

[45] Date of Patent: Mar. 18, 1997

[54] METHOD AND APPARATUS FOR CONDITIONING OF CHEMICAL-MECHANICAL POLISHING PADS

[75] Inventors: Kenneth C. Cadien; Leopoldo D. Yau, both of Portland, Oreg.

[73] Assignee: Intel Corporation, Santa Clara, Calif.

[21] Appl. No.: 536,467

[22] Filed: Sep. 29, 1995

[51] Int. Cl.[6] ..... B24B 29/00

[52] U.S. Cl. ..... 216/88; 156/636.1; 156/345; 451/444; 451/259; 451/287

[58] Field of Search ..... 451/259, 287; 156/345 L, 636.1; 216/88, 89

[56] References Cited

U.S. PATENT DOCUMENTS

| | | | |
|---|---|---|---|
| 2,826,009 | 3/1958 | Shurson . | |
| 4,481,738 | 11/1984 | Tabuchi | 51/5 R |
| 4,839,993 | 6/1989 | Masuko et al. | 51/129 |
| 4,984,390 | 1/1991 | Kobayashi | 51/5 D |
| 5,216,843 | 6/1993 | Breivogel et al. | 51/131.1 |
| 5,384,986 | 1/1995 | Hirose et al. | 451/444 |
| 5,456,627 | 10/1995 | Jackson et al. | 451/11 |
| 5,547,417 | 8/1996 | Breivogel et al. | 451/58 |

*Primary Examiner*—Robert Kunemund
*Assistant Examiner*—Michael E. Adjodha
*Attorney, Agent, or Firm*—Blakely, Sokoloff, Taylor & Zafman

[57] ABSTRACT

A method and apparatus for conditioning and/or rinsing a pad in a chemical-mechanical polisher. A scoring apparatus is rotated about its center directly over the polishing pad of the chemical-mechanical polisher. The scoring apparatus scores the pad surface while rotating above the pad. Consequently the pad is conditioned in a uniform and concentric fashion.

31 Claims, 5 Drawing Sheets

METHOD AND APPARATUS FOR CONDITIONING OF CHEMICAL-MECHANICAL POLISHING PADS

BACKGROUND OF THE INVENTION

1. Field of the Invention

The present invention relates to the field of semiconductor manufacturing, and more specifically to the field of chemical-mechanical polishing methods and apparatus for the conditioning and rinsing of polishing pads used in semiconductor manufacturing.

2. Background Information

In semiconductor manufacturing chemical-mechanical polishing is used to ensure planar topography in the fabrication of integrated circuits and other semiconductor devices. One particular type of chemical-mechanical polisher is an orbital polisher.

FIG. 1 illustrates a cross-sectional view of one preferred embodiment of an orbital polisher. During chemical-mechanical polishing with orbital polisher 100, a semiconductor wafer (wafer) 110 is placed onto polishing pad (pad) 130 which has been coated with an active slurry. Wafer 110 is held in place and pressed downward by carrier 120 with force $F_1$. Pad 130 is attached to the top of table 140. The downward force and the rotational movement of the pad together with the slurry facilitate the abrasive polishing of the upper surface of the wafer.

In the orbital polisher, illustrated in FIG. 1, an orbital polishing motion is used. As shown in FIG. 1, pad 130 is slightly larger than wafer 110, for example, the pad may be approximately 10 inches in diameter and the wafer may be approximately 8 inches in diameter. FIG. 2*a* illustrates a top view of pad 130 with wafer 110 which shows the relative size of the wafer to the pad of the orbital polisher. To facilitate the orbital motion polishing process, pad 130 is rotated about orbital axis 131 which is offset from the pad center (P) 132. Additionally, wafer 110 is rotated about its center (W), wafer center axis 111, which is also offset from pad center 132. The orbital motion of pad 130 with respect to wafer 110 is illustrated in FIG. 2*b*. While pad 130 and wafer 110 are being rotated, slurry is distributed to the wafer/pad interface through a plurality of equally spaced holes 133 formed throughout pad 130. This polishing process is continued until the desired planarity is reached.

During polishing the polishing pad has a tendency to "glaze over" due to the build-up on the pad surface of slurry and other deposits, that result from polishing the wafer. As a result of pad glazing, the pad will not absorb a sufficient amount of slurry and consequently the polishing rate of the chemical-mechanical polisher falls off with time, thus decreasing throughput. To prevent glazing, the polishing pad 130 is mechanically scored or "conditioned".

Conditioning the pad removes the slurry/deposit build-up and roughens the surface of pad 130, by "scoring" the surface of the pad. Scoring the pad roughens the surface of the pad, thus increasing the ability of the pad to absorb slurry and thereby increasing the polishing rate of the system. After or during conditioning, the pad is usually rinsed with water to remove the particles and etc. which were loosened during the conditioning of the pad.

Because the orbital polisher, illustrated in FIG. 1, uses orbital motion (i.e. off-center rotation of the pad) and because pad 130 is only slightly larger than wafer 110, it is not desirable to condition the wafer while simultaneously polishing the wafer. Thus, it is preferable to remove the wafer from the pad during conditioning. Also due to the orbital motion of the orbital polisher 100, a radial conditioner is not likely to be used.

Radial conditioners, as illustrated in FIG. 3, condition a radius of the pad. In other words, the radial conditioner conditions from the edge to the center of the pad and the pad itself is moved concentrically until the radial conditioner conditions the entire pad. An example of a method and apparatus for radial conditioning is described in Breivogal et al., U.S. Pat. No. 5,216,843, issued Jun. 8, 1993, and assigned to the assignee herein. Because of the off-center rotation of pad 130, radial conditioning would be non uniform, i.e. some areas of the pad would be scored more or less than other areas, and certain areas of the pad would not be scored at all. The motion of the pad about the radial conditioner 310 would look much like the motion of the pad about the wafer as illustrated in FIG. 2*b*, thus the pad would be conditioned in an orbital fashion rather than a concentric fashion.

Concentric conditioning is desirable since it helps with the distribution of the slurry at the pad/wafer interface and also because it allows for more uniform polishing of the wafer. Because the wafer is rotated about its center, i.e. wafer center (W), the wafer motion is concentric. Thus, since the wafer motion is concentric the preferred manner to correct for non-uniform polishing of that wafer is to use a conditioner with a concentric conditioning pattern.

A non-radial type of conditioner is illustrated in FIG. 4. Conditioner 400 works in a similar manner to a windshield-wiper. Conditioner 400 starts in a "park" position to the side of pad 130, it is then rotated back and forth about axis 410, such that arm 420 is moved back and forth over pad 130 scoring the pad surface 430. Arm 420 of conditioner 400 is approximately the same length as the diameter of pad 130 so that the entire pad may be conditioned. However, because the inside velocity ($v_i$), i.e. the velocity of arm 420 at the point closest to the axis 410, is smaller than the outside velocity ($v_o$), i.e. the velocity of arm 420 at the point furthest from the axis 410, the scoring of the pad 430 is non-uniform. Also, because conditioner 400 moves in a "windshield-wiper" type motion, conditioner 400 does not provide the desired concentric conditioning of the pad as described above.

Additionally, with respect to conditioner 400, if the pad is being conditioned using a high pressure spray there is a risk that the spray may be splashed all over the inside of the polisher. Because arm 420 is the same length as the diameter of the pad, the spray will not only strike the pad but will also overspray the edges of the pad and splash all over the chemical-mechanical polisher in the areas where the pad is shorter than arm 420. Consequently, after the pad is conditioned and another wafer is placed on the pad for polishing, the spray that has splashed all over the chemical-mechanical polisher could drop onto the wafer or mix with the slurry decreasing the abrasiveness of the slurry and consequently decreasing the polishing rate.

Thus, what is needed is a method and apparatus for conditioning a pad in a chemical-mechanical polisher, such that the pad is conditioned in a concentric and uniform manner, and where a high pressure spray is used the pad may be conditioned without the risk of splashing and overspraying.

SUMMARY OF THE INVENTION

A novel method and apparatus for conditioning a pad in a chemical-mechanical polisher is described. A scoring apparatus is rotated about its center directly over the polishing pad of the chemical-mechanical polisher. The scoring apparatus scores the pad while rotating above the pad such that the pad is conditioned in a uniform concentric fashion.

Additional features and benefits of the present invention will become apparent from the detailed description, figures, and claims set forth below.

BRIEF DESCRIPTION OF THE DRAWINGS

The present invention is illustrated by way of example and not limitation in the accompanying figures.

DETAILED DESCRIPTION

A method and apparatus for conditioning of chemical-mechanical polishing pads is disclosed. In the following description, numerous specific details are set forth such as specific equipment, materials, processes, dimensions, etc. in order to provide a thorough understanding of the present invention. It will be obvious, however, to one skilled in the art that these specific details need not be employed to practice the present invention. In other instances, well known materials or methods have not been described in detail in order to avoid unnecessarily obscuring the present invention.

Figure 1:
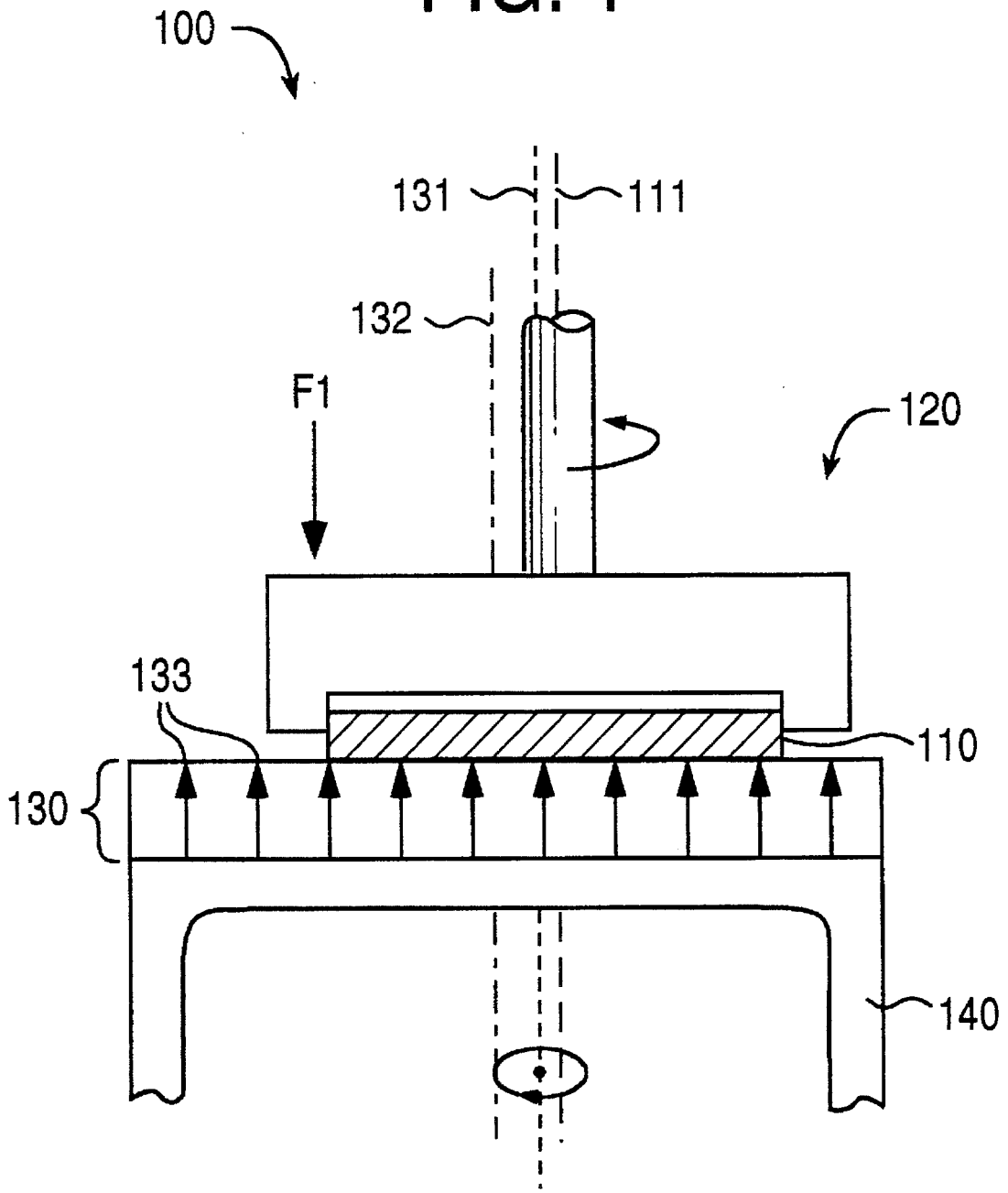
FIG. 1 illustrates a cross-sectional view of one preferred embodiment of a chemical-mechanical polisher.
Figure 2A:
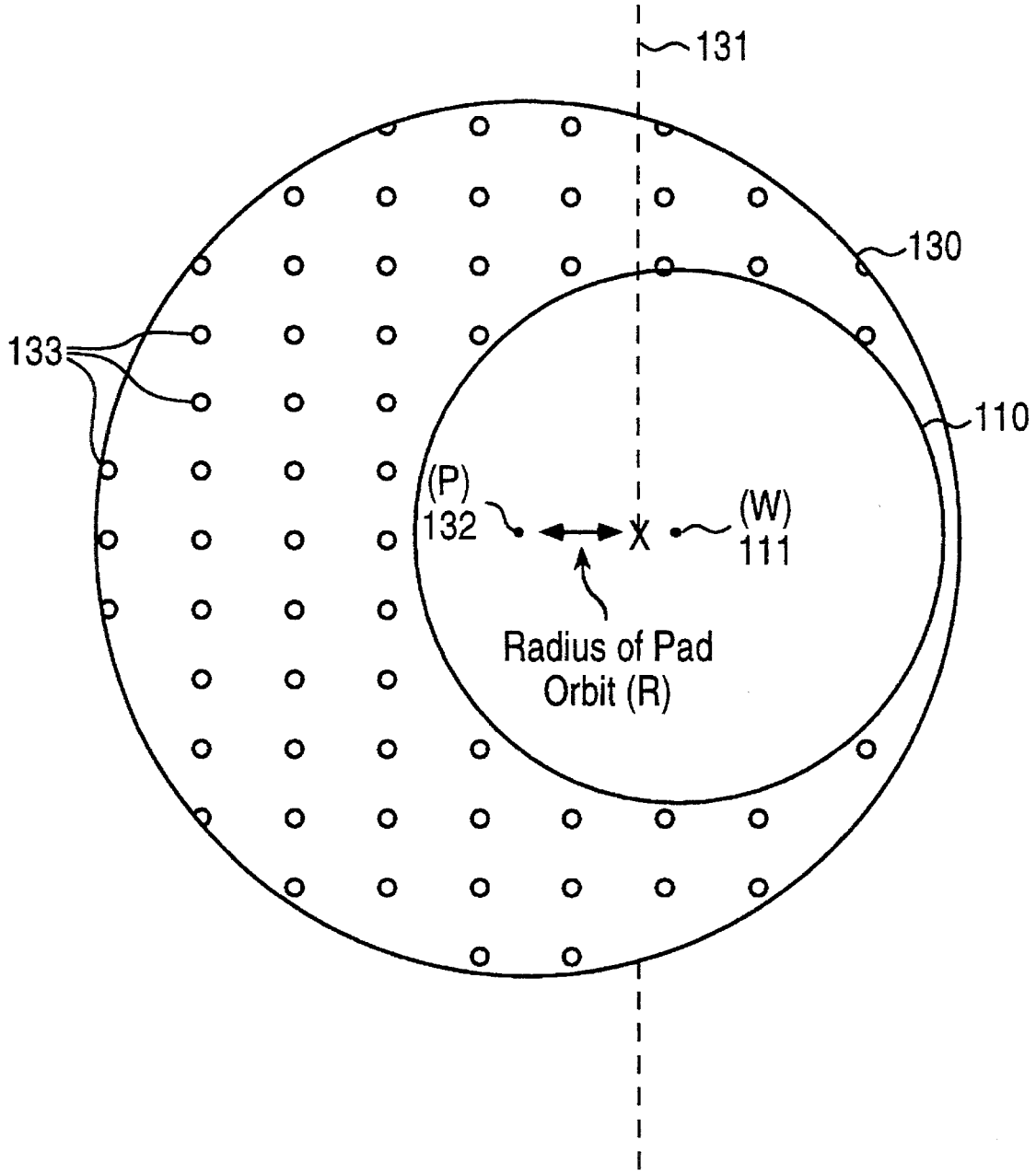
FIG. 2*a* illustrates a top view the wafer and pad of the chemical-mechanical polisher in FIG. 1.
Figure 2B:
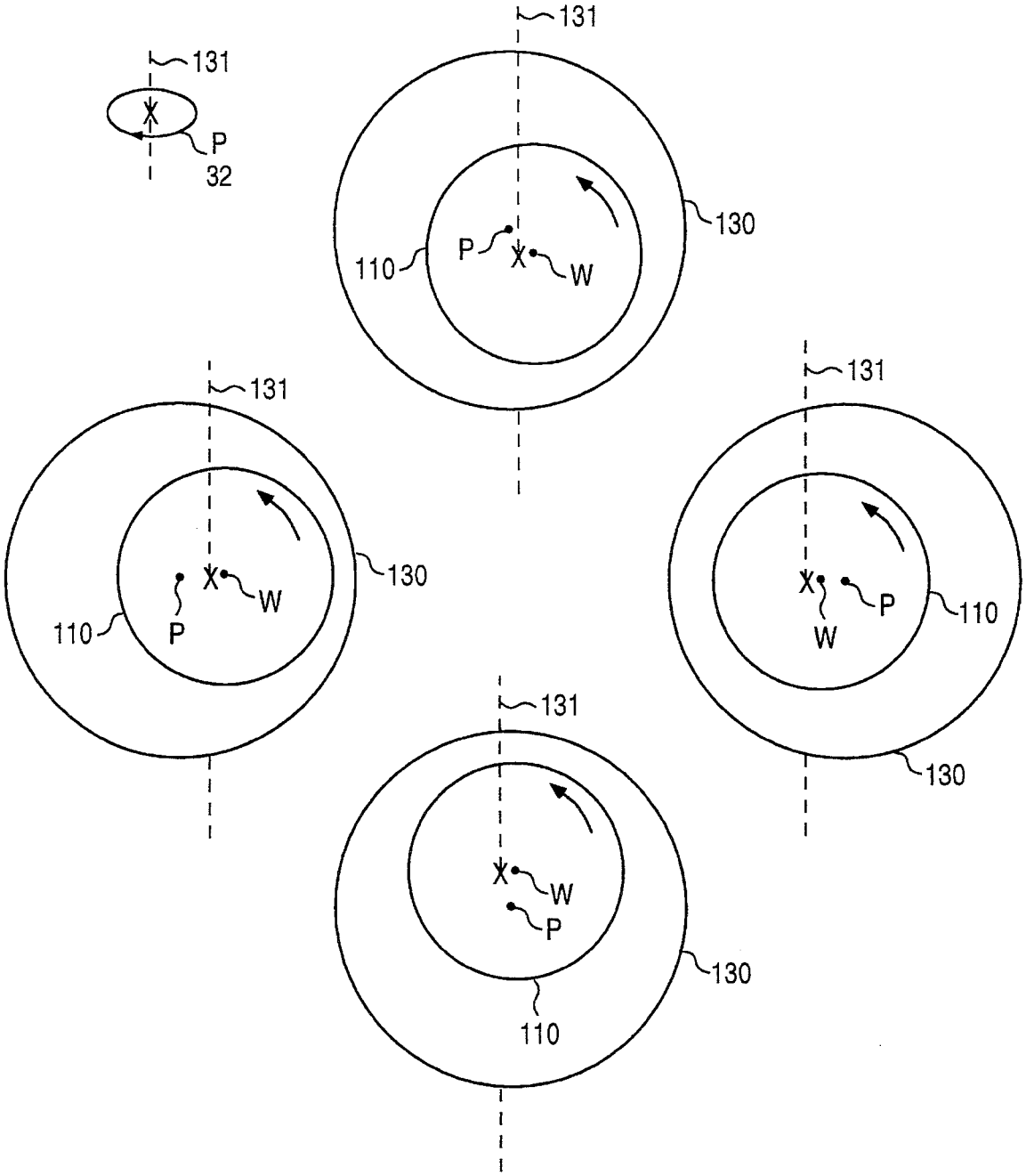
FIG. 2*b* illustrates the orbital motion of the wafer and pad of the chemical-mechanical polisher in FIG. 1.
Figure 3:
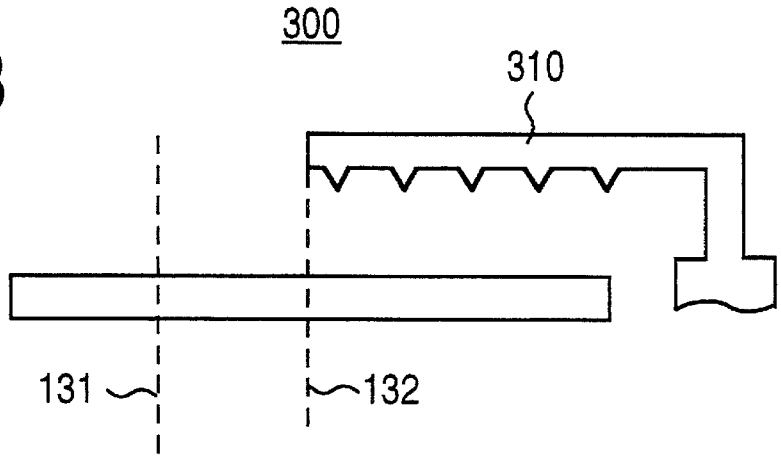
FIG. 3 illustrates one embodiment of radial conditioner.
Figure 4:
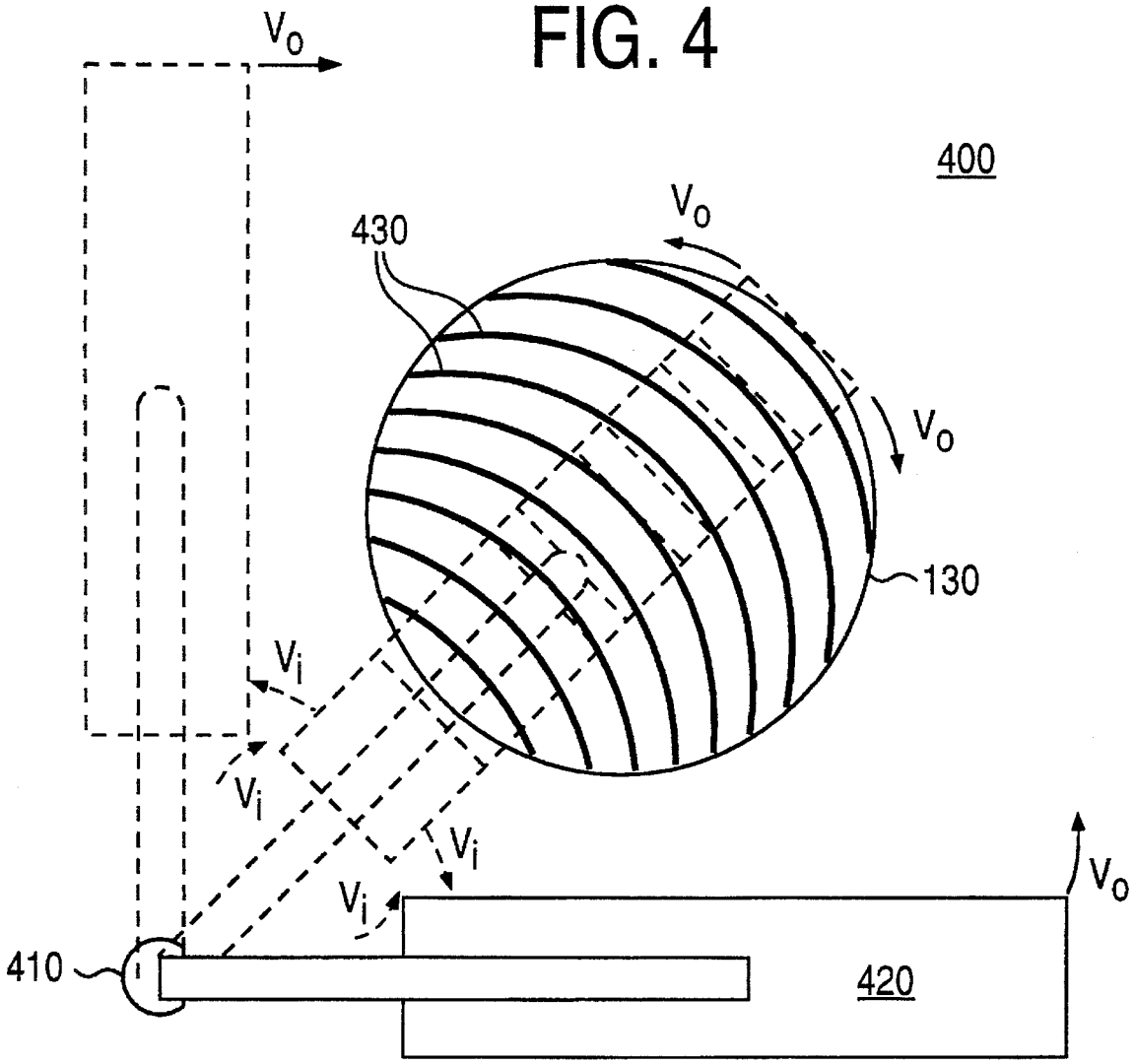
FIG. 4 illustrates one embodiment of a non-radial conditioner.

Pad 130 of the chemical-mechanical polisher, illustrated in FIG. 1, can be made up of a variety of materials. For example, in the planarization of an oxide based interlayer dielectric, the pad comprises a relatively hard polyurethane or similar material. In the polishing of a metal, such as tungsten, in the etchback step of a plug formation process, the pad can be a urethane impregnated felt pad. In one currently preferred embodiment a soft pad, the Polytech Supreme Pad, manufactured by Rodel Incorporated, is used in the orbital polisher illustrated in FIG. 1. The type of pad generally determines what method of conditioning should be used.

There are several methods with which a pad may be conditioned. Some examples of these methods are: scoring the pad surface with diamond points, brushes with stiff bristles, brushes with soft bristles, and high pressure spraying. As stated above, the method of conditioning used depends upon the type of pad being conditioned. For example, hard pad surfaces, such as polyurethane, may be conditioned using diamond points, intermediate pad surfaces may be conditioned using a brush with stiff bristles, and soft pad surfaces, such as a urethane impregnated felt pad, may be conditioned using a brush with soft bristles or a high pressure spray.

In the preferred embodiment, referred to above, wherein a soft pad is used in the orbital polisher 100, illustrated in FIG. 1, a preferred method of conditioning is the high pressure spray. It should be noted that although the present invention is described below with reference to a high pressure spray, it will be obvious to one with ordinary skill in the art that other methods of conditioning may also be used, for example, the diamond points and brushes discussed above. Additionally, it should be noted that although the present invention is described with reference to an orbital polisher it will also be obvious to one with ordinary skill in the art that it may be used in conjunction with other chemical-mechanical polishers to achieve similar results.

Figure 5A:
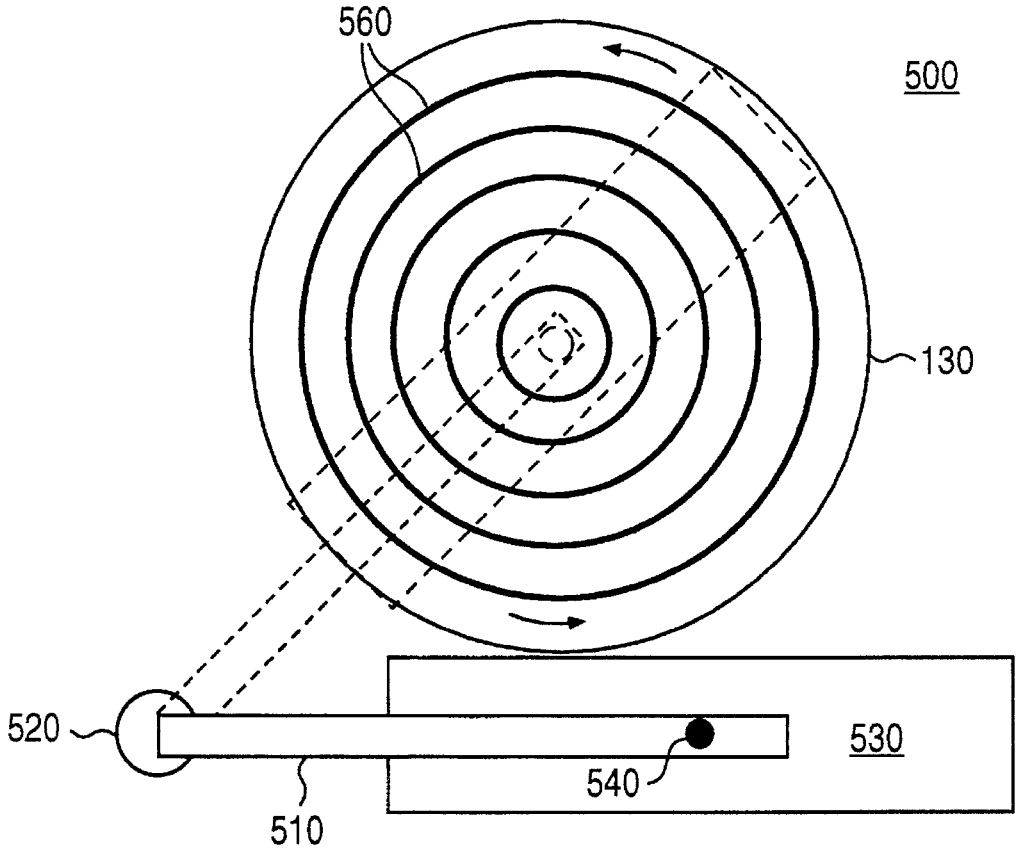
FIGS. 5*a* and 5*b* illustrate an overhead and cross-sectional view of one preferred embodiment of the present invention.
Figure 5B:
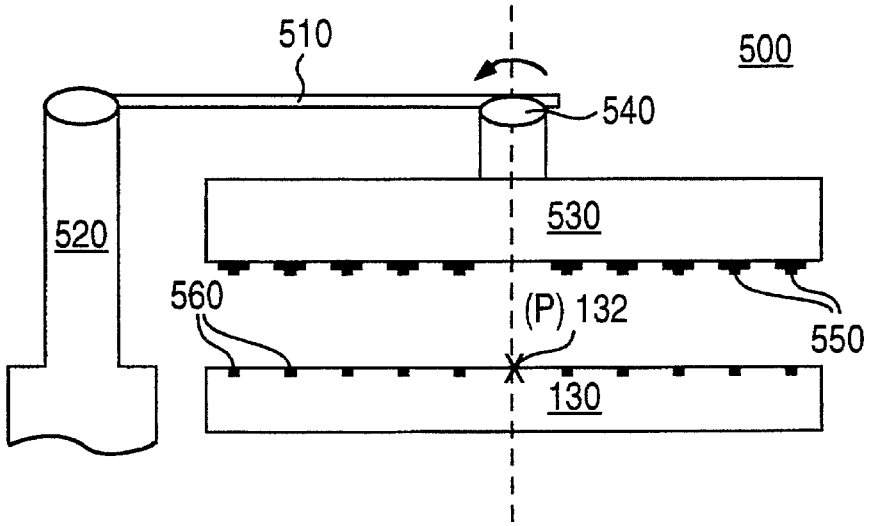

FIGS. 5*a* and 5*b* illustrate overhead and cross-sectional views of one preferred embodiment of the present invention, conditioning apparatus 500. Conditioner 500 may be used in conjunction with the chemical-mechanical polisher illustrated in FIG. 1, to score and/or rinse pad 130, such that pad 130 is concentrically and uniformly conditioned.

Referring to FIG. 5*a*, when the pad is in motion and a wafer is being polished, conditioner 500 remains in a "park" position to the side of pad 130. After a predetermined number of wafers have been polished by pad 130 or after the polishing rate has decreased below a particular user's desired level, due to the build-up of slurry and other debris, pad 130 should be conditioned. As described above, because of the orbital motion of orbital polisher 100, the wafer should be removed from the pad before the pad may be properly conditioned.

Once the wafer is removed from the pad and preferably after the pad has stopped rotating, the pad may be conditioned. Pivot arm 510 of conditioner 500 is pivoted about axis 520 from the park position at the side of pad 130 until it is extended directly over pad. It should be noted and it will be obvious 130. In one currently preferred embodiment pivot arm 510 is extended such that its end directly overlies the center of the pad. It should be noted and it will be obvious to one with ordinary skill in the art that although a diametric arm is illustrated in FIGS. 5*a* and 5*b* a radial arm may also be used.

Coupled to the end of pivot arm 510 that overlies the pad is bar 530. Bar 530 is rotatable about its center and is coupled to one end of pivot arm 510 by rotation axis 540. Rotation axis 540 is centered on bar 530 and directly overlies the pad center 132 (P). Because rotation axis 540 and pad center 132 lie along the same vertical line, bar 530 rotates about its center in a concentric motion over pad 130. It is this concentric motion of bar 530 about pad 130 that allows for concentric and uniform conditioning of the pad.

In a currently preferred embodiment of the present invention, as illustrated in FIG. 5*b*, a plurality of high pressure spray nozzles 550 are located on the bottom of bar 530. As bar 530 is rotated about axis 540, high pressure spray nozzles 550 spray high pressure streams of water onto pad 130. These high pressure streams of water score the pad surface 560 removing the build-up of slurry and other debris, thus increasing the slurry absorbency of the pad and thereby increasing the polish rate of the polishing system. It should be noted that spraying with water is one preferred embodiment of the present invention and it will be obvious to one with skill in the art that solutions other than water may be used with the high pressure spray.

It will be obvious to one with skill in the art that the pressure of high spray nozzles will depend upon the hardness of the pad surface, for example with softer pads lower pressures are used so that the pad is not ripped or damaged. The pressure of high pressure spray nozzles 550 may range anywhere from 10 to 1000 psi. In one currently preferred embodiment, in particular the embodiment described above utilizing the polytech supreme pad, pressures in the range of 25–100 psi are used. It will be obvious to one with skill in the art that rather than scoring the pad in the manner illustrated in FIGS. 5*a* and 5*b*, the high pressure spray nozzles may be selected such that the high pressure streams of water fan out and overlap thus conditioning the pad in a concentric but overlapping fashion.

To solve the problem of splashing and overspraying, in one preferred embodiment where high pressure spraying is used to condition the pad, bar 530 is the same length as the diameter of the pad. For example, if pad 130 is 10 inches in diameter, then bar 530 is 10 inches in length. Because bar 540 rotates about its center and the center of the bar is in the same vertical line as the pad center (P), the high pressure spray is only directed onto the pad and does not go over the edge of the pad. Thus, the spray does not splash all over the chemical-mechanical polisher. It will be obvious to one with ordinary skill in the art that bar 530 may also be less than the diameter of the pad in order to prevent splashing.

It will be obvious to one with ordinary skill in the art that other embodiments of the present invention may also be used. One embodiment, for example, is a high pressure spray apparatus with variable pressure nozzles where each nozzle may be independently set at varying spray pressures. The variable pressure apparatus may be used such that certain areas of the pad are conditioned at higher pressures than other areas. A variable pressure apparatus may be useful in processes where pad wear is non-uniform. Another embodiment, for example, is to use a circular spray head rather than the linear bar illustrated in FIGS. 5*a* and 5*b*. The circular spray head may be approximately the same diameter as the pad. Such a circular spray head may be rotated above the pad about its center to achieve similar results as that of the embodiments described above.

As noted above, it will be obvious to one with ordinary skill in the art that the high pressure spray nozzles 550 may be replaced with diamond points or brushes depending upon the surface hardness of the particular pad being used. If diamond points or brushes are used it will be obvious to one with skill in the art that the diamond points or brushes are placed in contact with the pad in order to score the pad surface 560.

If diamond points or brushes are used a rinse step may be beneficial after conditioning to rinse the loosened particles and debris off the pad. A rinse step may be incorporated into the present invention, for example, by including some high pressure spray nozzles intermittently with the diamond points or brushes on bar 530 in order to rinse the pad while simultaneously conditioning. Another example, would be to use two separate apparati, like the one illustrated in FIGS. 5*a* and 5*b*, the first one with diamond points or brushes to condition the pad and the second one with high pressure spray nozzles to rinse the pad of any debris that results from conditioning. The rinse step may be performed at lower pressures than conditioning, for example, one preferred embodiment rinses the pad with pressures from approximately 0 to approximately 40 psi.

Thus, by using conditioner 500 a pad may be conditioned in a uniform and concentric fashion. Uniform and concentric conditioning of a polishing pad allow for more uniform polishing of a wafer. Additionally, the use of the present invention helps to prevent overspraying and splashing when conditioning or rinsing a pad with a high pressure spray.

Thus, a method and apparatus for conditioning of chemical-mechanical polishing pads has been described. Although specific embodiments, including specific equipment, parameters, methods, and materials have been described, various modifications to the disclosed embodiments will be apparent to one of ordinary skill in the art upon reading this disclosure. Therefore, it is to be understood that such embodiments are merely illustrative of and not restrictive on the broad invention and that this invention is not limited to the specific embodiments shown and described.

What is claimed is:

1. Method for conditioning a pad comprising:

providing said pad;

rotating a scoring apparatus over said pad, wherein said scoring apparatus is rotated concentrically about the center of said pad; and scoring said pad.

2. The method as described in claim 1 wherein said step of scoring said pad further comprises:

scoring said pad with a plurality of diamond points, wherein said diamond points are located on said scoring apparatus and said diamond points of said scoring apparatus are placed in contact with said pad during said rotating step.

3. The method as described in claim 1 wherein said step of scoring said pad further comprises:

scoring said pad with a plurality of brushes, wherein said brushes are located on said scoring apparatus and said brushes of said scoring apparatus are placed in contact with said pad during said rotating step.

4. The method as described in claim 1 wherein said step of scoring said pad further comprises:

scoring said pad with a plurality of high pressure spray nozzles, wherein said high pressure spray nozzles are located on said scoring apparatus and spray said pad with high pressure streams of water during said rotating step.

5. Method for conditioning a pad comprising:

providing said pad;

placing a high pressure spray bar over said pad; and spraying said pad with a plurality of high pressure streams of water.

6. The method as described in claim 5 wherein said pad comprises a soft material.

7. The method as described in claim 5 wherein said bar is approximately the same length as the diameter of said pad.

8. The method as described in claim 5 wherein said bar is rotated concentrically about the center of said pad.

9. The method as described in claim 5 wherein said high pressure streams of water range from approximately 10–1000 psi.

10. Method for conditioning a pad comprising:

providing said pad;

rotating a scoring apparatus over said pad, wherein said scoring apparatus is a high pressure spray bar; and scoring said pad with a plurality of high pressure streams of water.

11. The method as described in claim 10 wherein said pad comprises a soft material.

12. The method as described in claim 10 wherein said bar is approximately the same length as the diameter of said pad.

13. The method as described in claim 10 wherein said bar is rotated concentrically about the center of said pad.

14. The method as described in claim 10 wherein said high pressure streams of water range from approximately 10–1000 psi.

15. Method for removing debris from a pad comprising:

providing said pad;

rotating a high pressure spray bar over said pad; and rinsing said pad with a plurality of high pressure streams of water.

16. The method as described in claim 15 wherein said bar is approximately the same length as the diameter of said pad.

17. The method as described in claim 15 wherein said bar is rotated concentrically about the center of said pad.

18. The method as described in claim 15 wherein said high pressure streams of water range from approximately 0–40 psi.

19. Method for conditioning and rinsing a pad comprising:

providing said pad;

rotating a high pressure spray bar concentrically over said pad, wherein said high pressure spray bar is approximately the same length as the diameter of said pad; and spraying said pad with a plurality of high pressure streams of water, wherein said high pressure streams of water range from approximately 10–1000 psi, such that said pad is scored and rinsed simultaneously by said high pressure streams of water.

20. An apparatus for conditioning a pad comprising:

a pivot arm, wherein said pivot arm is located to the side of said pad when not in operation and said pivot arm is extended over said pad when in operation;

a bar, wherein said bar is coupled to an end of said pivot arm such that said bar rotates concentrically about the center of said bar; and a scoring apparatus, wherein said scoring apparatus is mounted on said bar.

21. The apparatus as described in claim 20 wherein said bar has a length approximately equal to the diameter of said pad.

22. The apparatus as described in claim 20 wherein said bar is coupled to an end of said pivot arm that extends over said pad such that said bar is centered over said pad and rotates concentrically about the center of said pad.

23. The apparatus as described in claim 20 wherein said scoring apparatus further comprises:

a plurality of diamond points, wherein said diamond points are located along the length of said bar and said diamond points of said scoring apparatus are placed in contact with said pad when said pivot arm is extended over said pad.

24. The apparatus as described in claim 20 wherein said scoring apparatus further comprises:

a plurality of brushes, wherein said brushes are located along the length of said bar and said brushes of said scoring apparatus are placed in contact with said pad when said pivot arm is extended over said pad.

25. The apparatus as described in claim 20 wherein said scoring apparatus further comprises:

a plurality of high pressure spray nozzles, wherein said high pressure spray nozzles are located along the length of said bar and spray said pad with high pressure streams of water when said pivot arm is extended over said pad.

26. An apparatus for conditioning and rinsing a pad comprising:

a pivot arm, wherein said pivot arm is located to the side of said pad when not in operation and said pivot arm is extended over said pad when in operation;

a bar, wherein said bar is coupled to an end of said pivot arm such that said bar rotates concentrically about the center of said bar; and a scoring apparatus, wherein said scoring apparatus is mounted on said bar and wherein said scoring apparatus comprises a plurality of high pressure spray nozzles.

27. The apparatus as described in claim 26 wherein said bar has a length approximately equal to the diameter of said pad.

28. The apparatus as described in claim 26 wherein said bar is coupled to an end of said pivot arm that extends over said pad such that said bar is centered over said pad and rotates concentrically about the center of said pad.

29. The apparatus as described in claim 26 wherein said plurality of spray nozzles are mounted along the length of said bar.

30. The apparatus as described in claim 26 wherein said plurality of spray nozzles may each be independently set at varying spray pressures.

31. An apparatus for conditioning and rinsing a pad comprising:

a pivot arm, wherein said pivot arm is located to the side of said pad when not in operation and said pivot arm is extended over the center of said pad when in operation;

a bar, wherein said bar is coupled to an end of said pivot arm such that said bar rotates concentrically about the center of said bar, wherein said bar has a length approximately equal to the diameter of said pad, and wherein said bar is coupled to an end of said pivot arm that extends over said pad such that said bar is centered over said pad and rotates concentrically about the center of said pad; and a plurality of spray nozzles, wherein said plurality of spray nozzles are mounted along the length of said bar.

* * * * *